US009971284B2

(12) United States Patent
Kobaru

(10) Patent No.: US 9,971,284 B2
(45) Date of Patent: May 15, 2018

(54) FIXING DEVICE

(71) Applicant: CANON KABUSHIKI KAISHA, Tokyo (JP)

(72) Inventor: Yasunari Kobaru, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/635,049

(22) Filed: Jun. 27, 2017

(65) Prior Publication Data

US 2018/0004133 A1 Jan. 4, 2018

(30) Foreign Application Priority Data

Jun. 30, 2016 (JP) ..... 2016-130380

(51) Int. Cl.
*G03G 15/20* (2006.01)

(52) U.S. Cl.
CPC ..... *G03G 15/2007* (2013.01)

(58) Field of Classification Search
CPC ..... G03G 15/2007
USPC ..... 399/336
See application file for complete search history.

(56) References Cited

U.S. PATENT DOCUMENTS

2017/0248879 A1* 8/2017 Ishigaya ..... G03G 15/2007

FOREIGN PATENT DOCUMENTS

| | | | |
|---|---|---|---|
| JP | 2006-134645 | A | 5/2006 |
| JP | 2011-95540 | A | 5/2011 |
| JP | 2011-237495 | A | 11/2011 |
| JP | 2016-90960 | A | 5/2016 |

* cited by examiner

*Primary Examiner* — Susan Lee
(74) *Attorney, Agent, or Firm* — Canon U.S.A., Inc. IP Division

(57) ABSTRACT

A fixing device includes a cylindrical belt, a nip portion forming member contacting the belt, a halogen heater including a bulb filled with gas and having a sealing portion sealing the bulb, a filament inside the bulb and having a light emission portion, an external lead extending to outside the halogen heater, and a metal body arranged in the sealing portion and electrically connected the filament and the external lead, and a reflection member reflecting the radiation light of the halogen heater toward the nip portion forming member, the reflection member being long in a longitudinal direction of the halogen heater, wherein a longitudinal end of the reflection member is configured to lie in an area between an end of a light emission area constituted by the light emission portion of the halogen heater and the metal body in the longitudinal direction of the halogen heater.

5 Claims, 7 Drawing Sheets

FIXING DEVICE

BACKGROUND OF THE INVENTION

Field of the Invention

The present disclosure relates to a fixing device mounted on an electrophotographic image forming apparatus such as a copying machine and a printer.

Description of the Related Art

A fixing device used in an electrophotographic image forming apparatus is known to have the following configuration. Japanese Patent Application Laid-Open No. 2011-95540 discusses a fixing device which includes a belt, a pressure roller, a nip member, a halogen heater, and a reflection plate. The nip member makes contact with an inner surface of the belt and forms a nip portion with the pressure roller. The halogen heater radiates radiation light to heat the nip member. The reflection plate reflects the radiation light toward the nip member.

The halogen heater includes a glass tube that is filled with gas containing a halogen element, and sealing portions for sealing the glass tube. A filament wire (light emission portion) is arranged inside the glass tube.

In the foregoing fixing device, the reflection plate is arranged to surround the sealing portions of the halogen heater even in positions opposite to the sealing portions. The radiation light reflected by the reflection plate can thus cause an excessive temperature rise of the sealing portions. If the sealing portions of the halogen heater undergo an excessive rise in temperature, gas sealing performance drops. This causes a problem of lower gas concentration in the glass tube and reduced heater life.

SUMMARY OF THE INVENTION

According to an aspect of the present disclosure, a fixing device configured to fix an image to a recording material includes a cylindrical belt, a nip portion forming member configured to make contact with an inner surface of the belt, a backup member configured to form a nip portion with the nip portion forming member via the belt, a halogen heater arranged in a hollow portion of the belt to radiate radiation light toward the nip portion forming member, the halogen heater including a slender bulb that is filled with gas and includes, at a longitudinal end of the bulb, a sealing portion for sealing the bulb, a filament that is arranged inside the bulb and includes a light emission portion configured to emit light when energized, an external lead that extends to outside the halogen heater, and a metal body that is arranged in the sealing portion and configured to electrically connect the filament and the external lead, and a reflection member configured to reflect the radiation light of the halogen heater toward the nip portion forming member, the reflection member being long in a longitudinal direction of the halogen heater, wherein a longitudinal end of the reflection member is configured to lie in an area between an end of a light emission area constituted by the light emission portion of the halogen heater and the metal body in the longitudinal direction of the halogen heater.

According to another aspect of the present disclosure, a fixing device configured to fix an image to a recording material includes a cylindrical belt, a nip portion forming member configured to make contact with an inner surface of the belt, a backup member configured to form a nip portion with the nip portion forming member via the belt, a halogen heater arranged in a hollow portion of the belt to radiate radiation light toward the nip portion forming member, the halogen heater including a slender bulb filled with gas, the bulb including, at a longitudinal end of the bulb, a sealing portion for sealing the bulb, the sealing portion being a plate-like portion including a surface portion, and a reflection member configured to surround the halogen heater when viewed in the longitudinal direction of the halogen heater, the reflection member being long in a longitudinal direction of the halogen heater, the reflection member overlapping with the sealing portion in the longitudinal direction, the reflection member having a cutout portion or a hole portion in an area opposed to the surface portion of the sealing portion.

According to yet another aspect of the present disclosure, a fixing device configured to fix an image to a recording material includes a cylindrical belt, a nip portion forming member configured to make contact with an inner surface of the belt, a backup member configured to form a nip portion with the nip portion forming member via the belt, a halogen heater arranged in a hollow portion of the belt to radiate radiation light toward the nip portion forming member, the halogen heater including a slender bulb filled with gas, the bulb including, at a longitudinal end of the bulb, a sealing portion for sealing the bulb, and a reflection member configured to reflect the radiation light of the halogen heater toward the nip portion forming member, the reflection member being long in a longitudinal direction of the halogen heater, the reflection member being configured so that the longitudinal end lies on an inner side of the sealing portion in the longitudinal direction of the halogen heater.

Further features of the present disclosure will become apparent from the following description of exemplary embodiments with reference to the attached drawings.

DESCRIPTION OF THE EMBODIMENTS

<Overview of Image Forming Apparatus>

Figure 1:
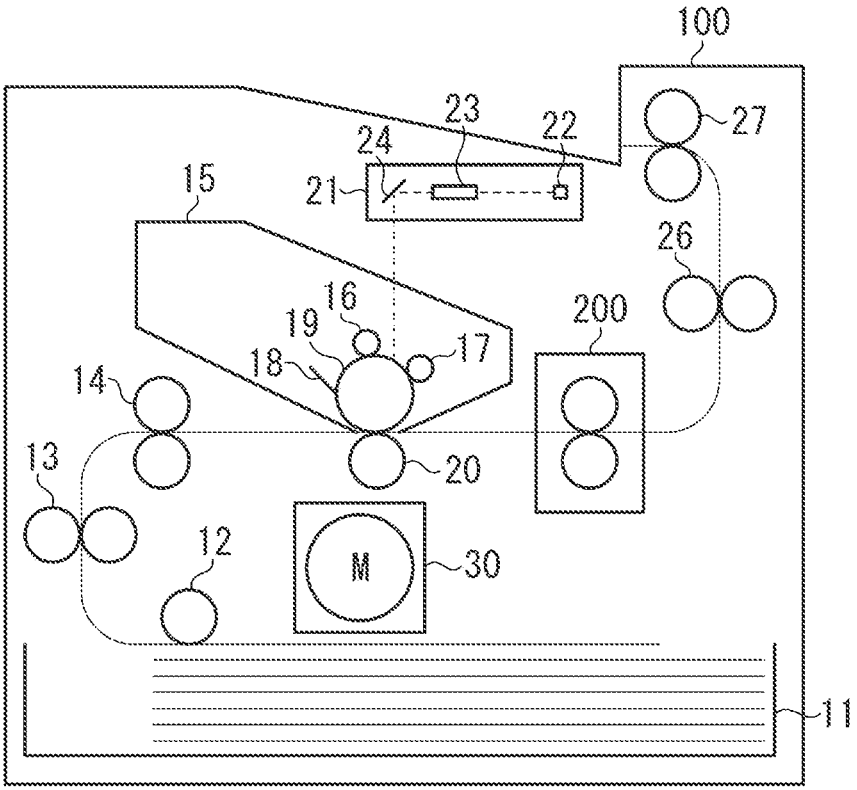
FIG. 1 is an explanatory diagram of an image forming apparatus used in an exemplary embodiment of the present disclosure.

FIG. 1 is a sectional view of a laser printer (image forming apparatus) 100 using an electrophotographic recording technique. If a print signal occurs, a scanner unit 21 emits laser light modulated according to image information and scans a photosensitive member 19 charged to a predetermined polarity by a charging roller 16. This forms an electrostatic latent image on the photosensitive member 19. A developing device 17 supplies toner to the electrostatic latent image, whereby a toner image according to the image information is formed on the photosensitive member 19. Meanwhile, recording sheets (recording materials) P stacked on a feed cassette 11 are fed by a pickup roller 12 one by one, and conveyed to a registration roller 14 by a roller 13. The recording sheet P is further conveyed from the registration roller 14 to a transfer position formed by the photosensitive member 19 and a transfer roller 20 in synchronization with timing when the toner image on the photosensitive member 19 reaches the transfer position. In the process of the recording sheet P passing the transfer position, the toner image on the photosensitive member 19 is transferred to the recording sheet P. The recording sheet P is then heated in a fixing device 200, whereby the toner image is heated and fixed to the recording sheet P. The recording sheet P bearing the fixed toner image is discharged to a tray on top of the laser printer 100 by rollers 26 and 27. A cleaner 18 cleans the photosensitive member 19. A motor 30 drives the fixing device 200. The photosensitive member 19, the charging roller 16, the scanner unit 21, the developing device 17, and the transfer roller 20 mentioned above constitute an image forming unit for forming an unfixed image on the recording sheet P.

<Configuration and Operation of Fixing Device>

Figure 2:
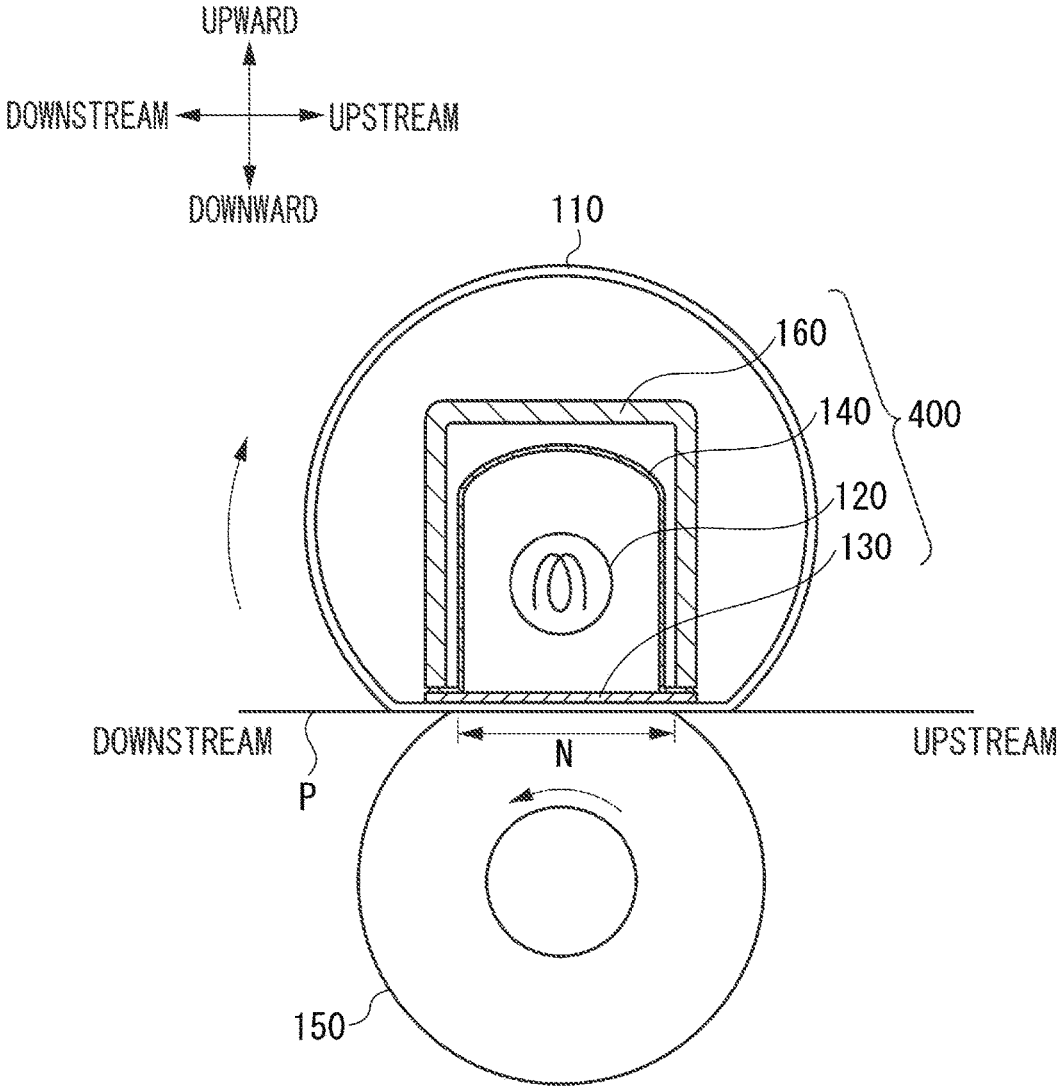
FIG. 2 is a sectional view of a fixing device according to a first exemplary embodiment.

FIG. 2 is a sectional view of the fixing device 200. In the following description, an upstream side and a downstream side in a conveyance direction of the recording sheet P will be referred to as "upstream" and "downstream", respectively. Up and down directions in a diagram will be referred to as "upward" and "downward", respectively.

As illustrated in FIG. 2, the fixing device 200 includes a belt 110, a heating unit 400, and a pressure roller 150 serving as a backup member.

The belt 110 is a heat-resistant, flexible endless (cylindrical) sleeve or resin film.

The heating unit 400 is arranged inside the belt 110. The heating unit 400 includes a halogen heater 120 serving as a heating source, a nip plate 130 serving as a nip portion forming member, a reflection plate 140 serving as a reflection member, and a stay 160 serving as a reinforcement member.

The halogen heater 120 is a heating source for heating the belt 110 via the nip plate 130 and thereby heating the toner on the recording sheet P. The halogen heater 120 is arranged in the hollow portion of the belt 110 to not make contact with the reflection plate 140 or the nip plate 130.

The nip plate 130 is a plate-like member to receive and be heated by radiation light from the halogen heater 120. The nip plate 130 is arranged to make contact with and slide on an inner surface of the belt 110. The heat of the nip plate 130 heated by the radiation light received from the halogen heater 120 is transferred to the toner on the recording sheet P via the belt 110. The nip plate 130 is a plate-like member having a thickness of approximately 1 mm, made of a high thermal conductivity material such as aluminum. An inner surface (upward surface in FIG. 2) of the nip plate 130 is almost entirely painted in black. This enables efficient absorption of the radiation light from the halogen heater 120.

The reflection plate 140 is a member for reflecting the radiation light from the halogen heater 120 toward the nip plate 130. The reflection plate 140 is made of an aluminum plate having high reflectance to infrared and far infrared rays. The reflection plate 140 can intensively irradiate the nip plate 130 with the radiation light from the halogen heater 120 so that the belt 110 is quickly heated by efficient use of the radiation light from the halogen heater 120. The reflection plate 140 is arranged to surround the halogen heater 120 in a circumferential direction of the belt 110 when viewed in a longitudinal direction of the halogen heater 120.

The stay 160 is a laterally long member that is made rigid by bending an iron sheet into a U shape. The stay 160 is arranged to cover the reflection plate 140. The stay 160 also has the function of supporting and reinforcing the reflection plate 140 and the nip plate 130.

In FIG. 2, the pressure roller 150 serving as the backup member is a member including a metal core and an elastic layer formed on the outside of the metal core. Both longitudinal ends of the stay 160 are pressed toward the pressure roller 150 by a not-illustrated biasing member, whereby the pressure roller 150 forms a nip portion N with the nip plate 130 via the belt 110. The pressure roller 150 is configured to be driven by driving force transmitted from the motor 30 of the laser printer 100. The recording sheet P bearing a toner image is nipped and conveyed by the nip portion N while the toner image is fixed to the recording sheet P.

<Configuration of Heating Unit>

Next, a configuration of the heating unit 400 will be described with reference to FIG. 3.

Figure 3:
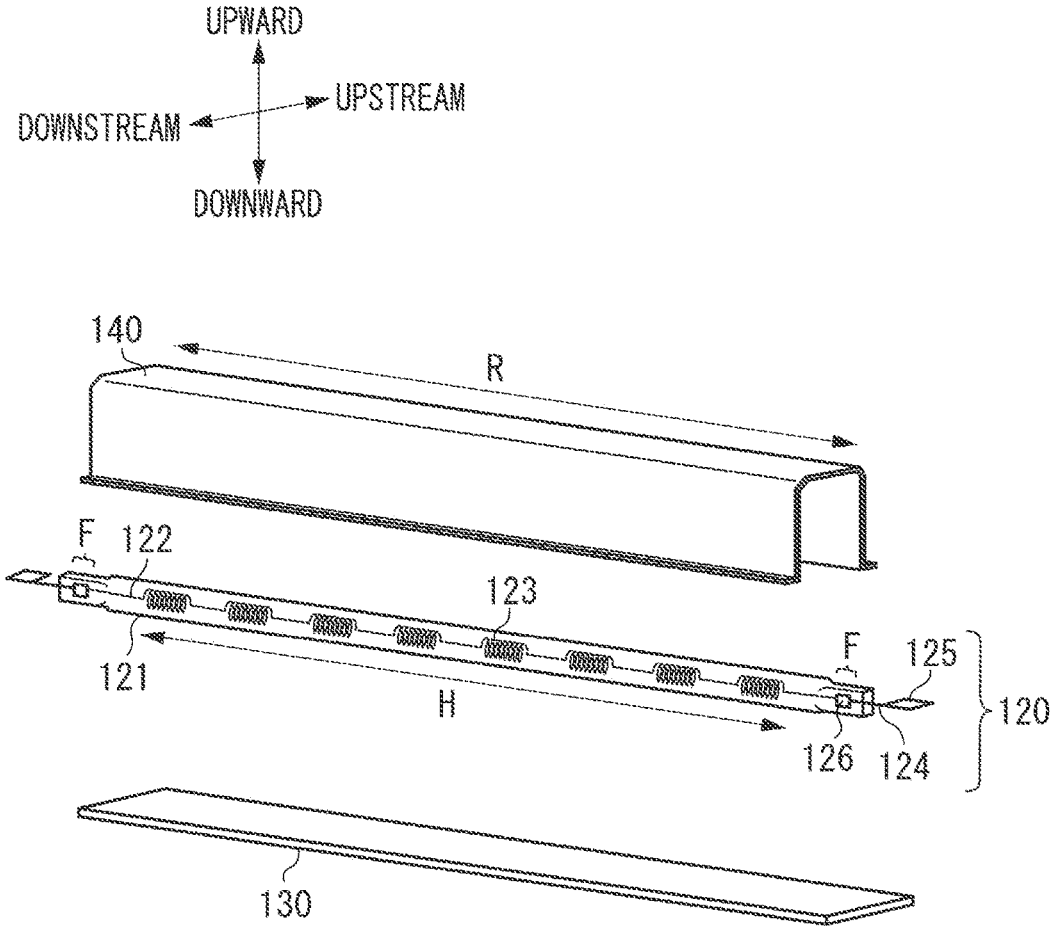
FIG. 3 is a perspective view illustrating a reflection plate, a halogen heater, and a nip plate which are components of a heating unit according to the first exemplary embodiment.

FIG. 3 is a perspective view of the halogen heater 120, the nip plate 130, and the reflection plate 140 which are components of the heating unit 400. For the sake of simplicity, the stay 160 is omitted.

As illustrated in FIG. 3, the halogen heater 120 includes a slender cylindrical glass tube (bulb) 121. A filament (tungsten wire) 122 is arranged inside the glass tube 121. The glass tube 121 is filled with gas containing a halogen element. The glass tube 121 includes sealing portions F for sealing both longitudinal ends. The sealing portions F are formed in plate-like shape by pinch sealing. The filament 122 includes a plurality of helically-wound coil portions 123 in an area (hereinafter, referred to as a light emission area H) corresponding to a maximum sheet-passing width of a recording sheet, and non-emission portions of a straight shape outside the light emission area H. The coil portions 123 serve as light emission portions which emit light when energized. The non-emission portions do not emit light when energized. Coil lengths of the respective coil portions 123 and distances between the coil portions 123 can be adjusted to obtain a desired heat generation distribution. The present exemplary embodiment deals with an example of coils that provide an almost flat heat generation distribution within the maximum sheet-passing width.

The halogen heater 120 includes a pair of straight-shaped external leads 124 protruding outward (in directions away from the center of the halogen heater 120) from the respective longitudinal ends of the glass tube 121. There are metal foils 126 (molybdenum foils) on longitudinally inner sides of the external leads 124, and terminal-shaped metal plates 125 on longitudinally outer sides of the external leads 124. The metal foils 126 serve as metal bodies electrically connected to the non-emission portions of the filament 122. The metal foils 126 are provided in positions corresponding to the sealing portions F of the glass tube 121. The metal foil 126 and part of the external lead 124 arranged inside the glass tube 121 are embedded in the sealing portion F. The non-emission portion of the filament 122, the metal foil 126, and the external lead 124 are connected by welding. The sealing portions F are pinch-sealed to form sealing surfaces so that the metal foil 126 is pinched by the glass tube 121 from both sides to not leave a gap between the metal foil 126 and the glass tube 121. The gas concentration in the glass tube 121 is thus maintained within a desired range. Maintaining the gas concentration in the glass tube 121 within a desired range can contribute to longer life of the halogen heater 120 by the halogen cycle. The halogen cycle refers to an action in which evaporated elements of the hot filament form a compound with the halogen elements and return to the filament wire.

The halogen heater 120 is held at predetermined distances from the reflection plate 140 and the nip plate 130 by fixing the terminal-shaped metal plates 125 on the longitudinally outer sides of the external leads 124 with not-illustrated support members and covering the halogen heater 120 with the reflection plate 140 from above and with the nip plate 130 from below.

In the present exemplary embodiment, the longitudinal lengths of the light emission area H of the halogen heater 120, the reflection plate 140, and the nip plate 130 have the following relationship. The reflection plate 140 has a length R greater than the length of the light emission area H of the halogen heater 120. The nip plate 130 has a length even greater than the length R of the reflection plate 140. As will be described below, such a configuration can reduce loss of the radiation light at the longitudinal ends of the halogen heater 120.

Next, a positional relationship between the halogen heater 120, the reflection plate 140, and the nip plate 130 in the longitudinal direction, which is a characteristic of the present exemplary embodiment, will be described with reference to FIG. 4.

Figure 4:
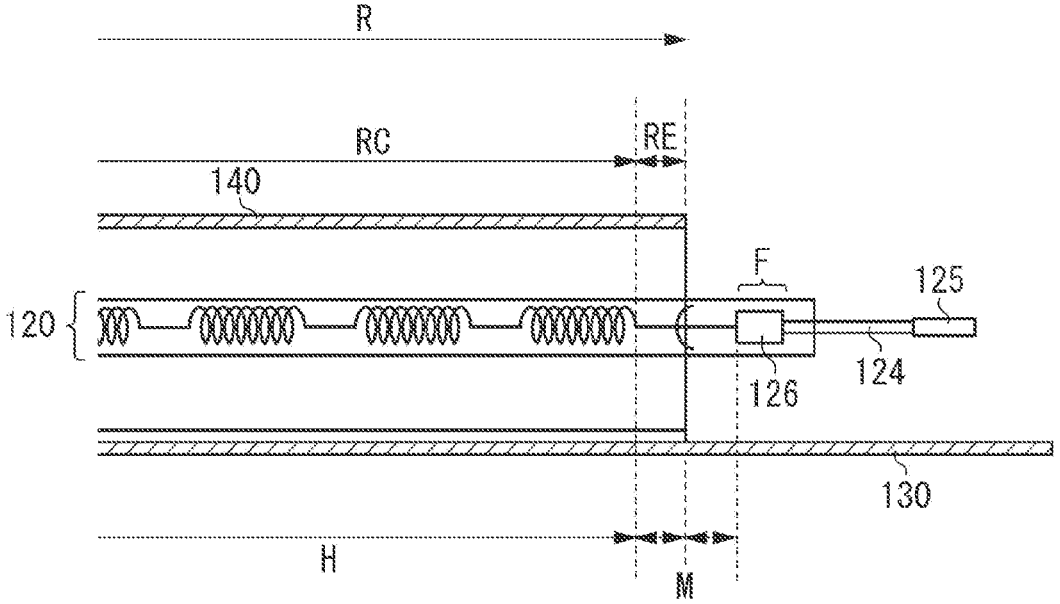
FIG. 4 is an enlarged sectional view of a longitudinal end portion of the heating unit according to the first exemplary embodiment.

FIG. 4 is an enlarged sectional view of one longitudinal end portion of the heating unit 400 as seen in the conveyance direction of the recording material in the nip portion N. The other end portion of the heating unit 400 has a structure symmetrical to that of the one end portion with respect to the longitudinal center of the halogen heater 120. A description thereof will thus be omitted. For convenience of description, the area of the reflection plate 140 is divided into a central reflection portion (represented by RC in FIG. 4) and an end reflection portion (represented by RE in FIG. 4). The central reflection portion RC corresponds to the light emission area H of the halogen heater 120. The end reflection portion RE corresponds to an area longitudinally outside the light emission area H of the halogen heater 120.

As illustrated in FIG. 4, the reflection plate 140 according to the present exemplary embodiment is characterized in that the longitudinal ends of the reflection plate 140 lie inside the sealing portions F at both ends of the halogen heater 120. In other words, the reflection plate 140 is arranged not to overlap the sealing portions F in the longitudinal direction.

Such a configuration can reduce the amount of radiation light reflected from the longitudinal end portions of the light emission area H of the halogen heater 120 to the sealing portions F. Even if the image forming apparatus 100 continuously performs image forming operations and the lighting time of the halogen heater 120 increases, an excessive temperature rise of the sealing portion F including the metal foil 126 can thus be suppressed. This can suppress oxidation and degradation of the metal foil 126 in the sealing portion F due to long hours of exposure to high temperature. The action of the halogen cycle can be maintained for a long period of time, which contributes to longer life of the halogen heater 120.

It is preferable that the longitudinal end of the reflection plate 140 is located in an area between the metal foil 126 and the outermost coil portion 123 in the light emission area H. As illustrated in FIG. 4, it is further preferable that the longitudinal end of the reflection plate 140 is configured to fall on an inner side of a midpoint M of the area between the metal foil 126 and the outermost coil portion 123 in the light emission area H. This can reduce the amount of radiation light reflected to the sealing portion F and can thus suppress a temperature rise of the sealing portion F more effectively.

A second exemplary embodiment of the present disclosure will be described with reference to FIGS. 5 and 6. In the present exemplary embodiment, portions similar to those of the configuration described in the first exemplary embodiment are designated by the same reference numerals. A description of configurations and functions similar to those of the first exemplary embodiment will be omitted, and only characteristic portions of the present exemplary embodiment will be described.

Figure 5:
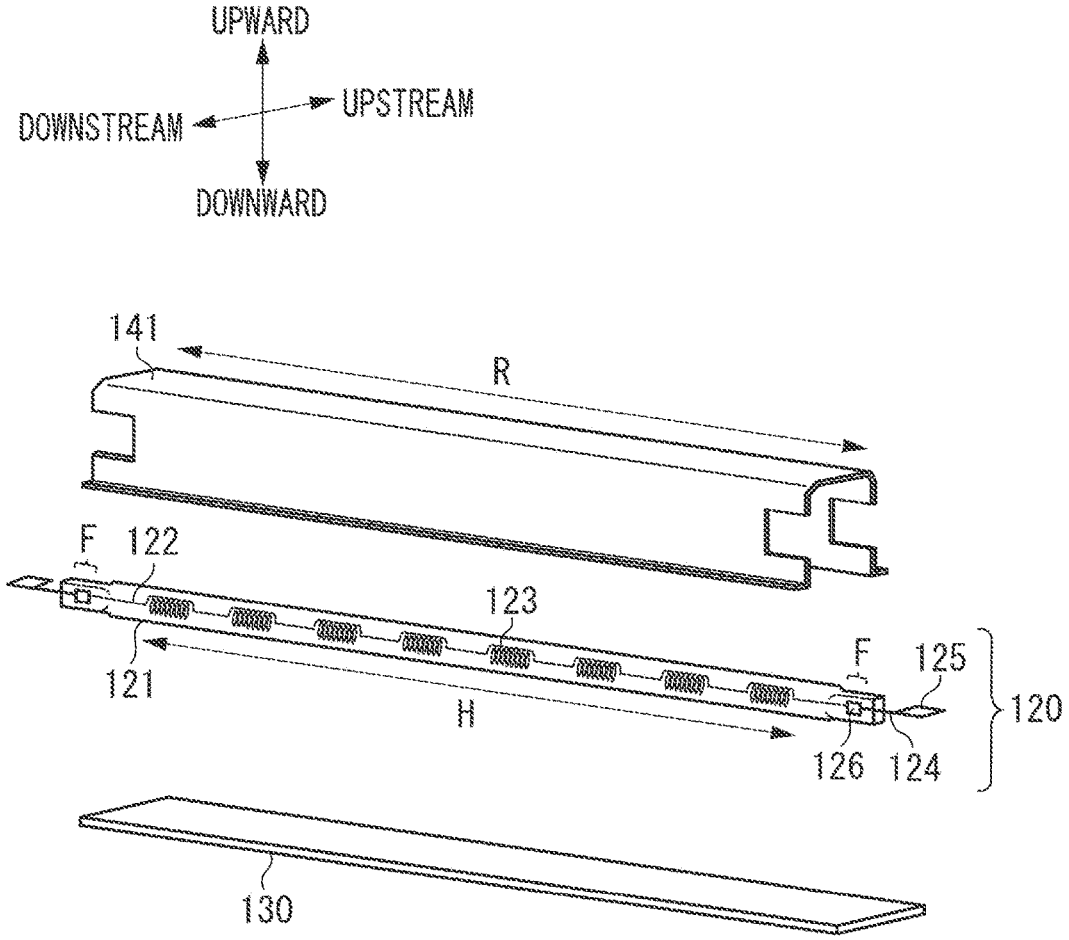
FIG. 5 is perspective view illustrating a reflection plate, a halogen heater, and a nip plate which are components of a heating unit according to second exemplary embodiment.

FIG. 5 is a perspective view of the halogen heater 120, the nip plate 130, and the reflection plate 140 which are components of the heating unit 400 according to the present exemplary embodiment.

Figure 6:
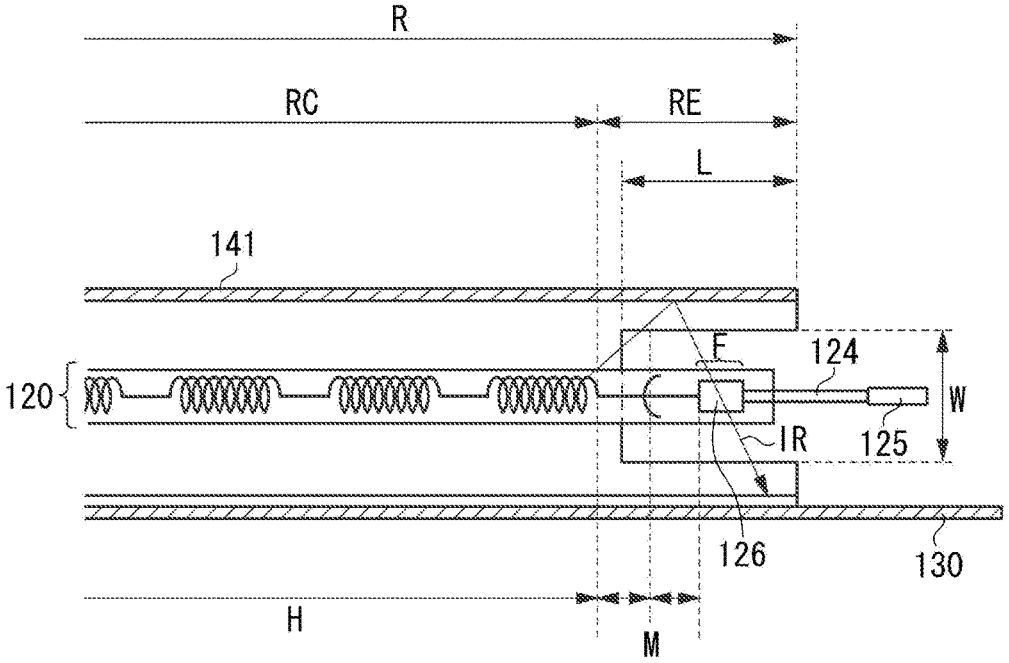
FIG. 6 is an enlarged sectional view of a longitudinal end portion of the heating unit according to the second exemplary embodiment.

FIG. 6 is an enlarged sectional view of one end portion of the heating unit 400 as seen in the conveyance direction of a recording material in the nip portion N of the fixing device 200. The stay 160 is omitted in FIG. 6. Since the heating unit 400 has a similar schematic configuration on the other end side, only one end portion will be described.

As illustrated in FIG. 6, the sealing portion F of the halogen heater 120 is a plate-like portion including a surface portion (hereinafter, referred to as a sealing surface) which is formed by sandwiching the metal foil 126 between glass surfaces. In the present exemplary embodiment, the sealing surface is formed so that its normal direction is parallel to the conveyance direction in the nip portion N. A reflection plate 141 according to the present exemplary embodiment is arranged to overlap the sealing portion F in the longitudinal direction. The reflection plate 141 is characterized in that areas of the reflection plate 141 opposite to the sealing surface of the sealing portion F (or the surface of the metal foil 126) are cut out at least in part. Specifically, in FIG. 6, the upper surface of the end reflection portion RE of the reflection plate 141 is long enough to overlap the sealing portion F of the halogen heater 120 in the longitudinal direction. The surfaces of the end reflection portion RE of the reflection plate 141 of which the normal direction is the conveyance direction of the recording material in the nip portion N are cut out in part. If the reflection plate 141 has such a configuration, radiation heat radiated substantially upward from the light emission area H of the halogen heater 120 in FIG. 5 is reflected from the area of the end reflection portion RE and absorbed into the nip plate 130. The radiation light here is less likely to be absorbed by the sealing portion F since the direction of the radiation light is parallel to the sealing surface. Radiation light radiated from the light emission area H of the halogen heater 120 upstream and downstream in the conveyance direction of the recording material in the nip portion N is not reflected toward the sealing portion F since the reflection plate 140 is cut out. An excessive temperature rise of the sealing portion F (metal foil) can thus be suppressed. As result, the life of the halogen heater 120 can be extended.

A distance L by which the side surfaces of the reflection plate 141 are cut out from the longitudinal end will be described. Considering the radiation heat radiated upstream and downstream from the end portion of the light emission area H of the halogen heater 120, the effect of suppressing a temperature rise can be provided if the reflection plate 141 is cut out by a length at least up to the inner side of the metal foil 126. It is more preferable that the reflection plate 141 can be cut into an inner side of the midpoint (M in FIG. 6)

between the inner side of the metal foil 126 and the outer side of the outermost coil portion 123.

To effectively reduce the amount of radiation light reflected toward the sealing portion F, a vertical width W by which the side surfaces of the reflection plate 141 are cut out can be at least greater than or equal to the diameter of the glass tube 121 of the halogen heater 120.

Figure 7:
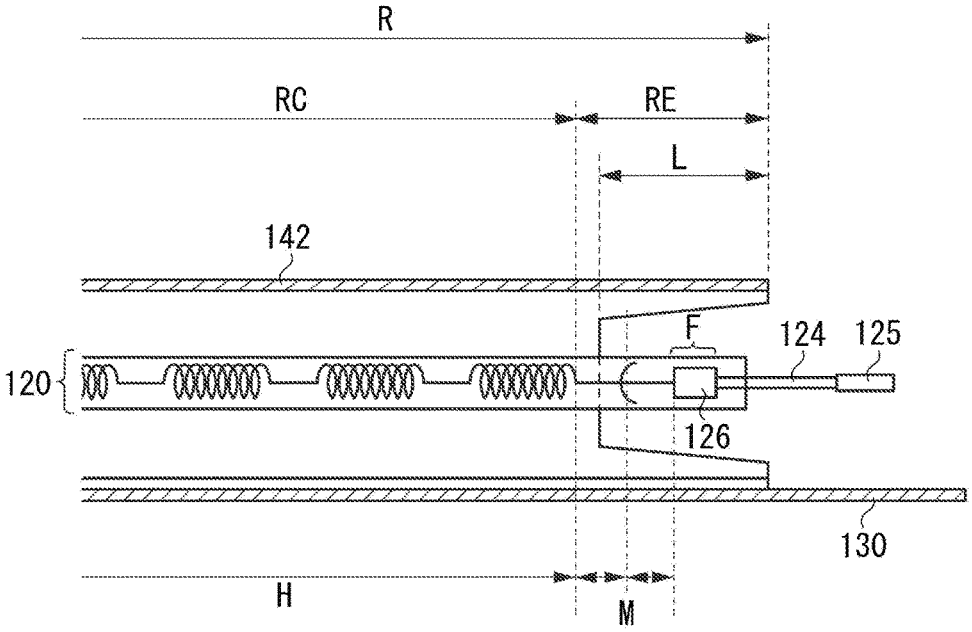
FIG. 7 is an enlarged sectional view of a longitudinal end portion of a heating unit according to a modification of the second exemplary embodiment.

The vertical cutout width W of the reflection plate 141 in FIG. 6 may be tapered so that the cuts widen from the longitudinal inner side to the longitudinal outer side of the reflection plate 141 as illustrated in FIG. 7. Such a configuration can achieve both reduction of loss of the radiation light at the longitudinal end of the halogen heater 120 and suppression of a temperature rise of the sealing portion F (metal foil).

In the present exemplary embodiment, the sealing surface of the halogen heater 120 is described to be arranged in a direction such that its normal direction is the conveyance direction of the recording material in the nip portion N. However, this is not restrictive. The provision of a cutout in an area of the reflection plate 141 opposite to the sealing surface can provide a similar effect if the sealing surface of the halogen heater 120 is arranged in a direction such that its normal direction is the direction of pressing of the nip portion N or even other directions.

Instead of the cutout portions, the reflection plate 141 may have through holes in the areas opposed to the sealing surface of the sealing portion F.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-130380, filed Jun. 30, 2016, which is hereby incorporated by reference herein in its entirety.

What is claimed is:

1. A fixing device configured to fix an image to a recording material, the fixing device comprising:

a cylindrical belt;

a nip portion forming member configured to make contact with an inner surface of the belt;

a backup member configured to form a nip portion with the nip portion forming member via the belt;

a halogen heater arranged in a hollow portion of the belt to radiate radiation light toward the nip portion forming member, the halogen heater including a slender bulb filled with gas, the bulb including, at a longitudinal end of the bulb, a sealing portion for sealing the bulb; and a reflection member configured to reflect the radiation light of the halogen heater toward the nip portion forming member, the reflection member being long in a longitudinal direction of the halogen heater, the reflection member being configured so that the longitudinal end lies on an inner side of the sealing portion in the longitudinal direction of the halogen heater.

2. A fixing device configured to fix an image to a recording material, the fixing device comprising:

a cylindrical belt;

a nip portion forming member configured to make contact with an inner surface of the belt;

a backup member configured to form a nip portion with the nip portion forming member via the belt;

a halogen heater arranged in a hollow portion of the belt to radiate radiation light toward the nip portion forming member, the halogen heater including a slender bulb that is filled with gas and includes, at a longitudinal end of the bulb, a sealing portion for sealing the bulb, a filament that is arranged inside the bulb and includes a light emission portion configured to emit light when energized, an external lead that extends to outside the halogen heater, and a metal body that is arranged in the sealing portion and configured to electrically connect the filament and the external lead; and a reflection member configured to reflect the radiation light of the halogen heater toward the nip portion forming member, the reflection member being long in a longitudinal direction of the halogen heater, wherein a longitudinal end of the reflection member is configured to lie in an area between an end of a light emission area constituted by the light emission portion of the halogen heater and the metal body in the longitudinal direction of the halogen heater.

3. The fixing device according claim 2, wherein the reflection member is arranged to surround the halogen heater when viewed in the longitudinal direction of the halogen heater.

4. A fixing device configured to fix an image to a recording material, the fixing device comprising:

a cylindrical belt;

a nip portion forming member configured to make contact with an inner surface of the belt;

a backup member configured to form a nip portion with the nip portion forming member via the belt;

a halogen heater arranged in a hollow portion of the belt to radiate radiation light toward the nip portion forming member, the halogen heater including a slender bulb filled with gas, the bulb including, at a longitudinal end of the bulb, a sealing portion for sealing the bulb, the sealing portion being a plate-like portion including a surface portion; and a reflection member configured to surround the halogen heater when viewed in the longitudinal direction of the halogen heater, the reflection member being long in a longitudinal direction of the halogen heater, the reflection member overlapping with the sealing portion in the longitudinal direction, the reflection member having a cutout portion or a hole portion in an area opposed to the surface portion of the sealing portion.

5. The fixing device according to claim 4, wherein the halogen heater is arranged so that a normal to the surface portion of the sealing portion is in a direction along a conveyance direction of the recording material.

* * * * *